US005588644A

United States Patent [19]

Lotto et al.

[11] Patent Number: 5,588,644

[45] Date of Patent: Dec. 31, 1996

[54] INTERLEAVING APPARATUS FOR ROLLED UP SEGMENTS

[75] Inventors: Ronald L. Lotto, Bonduel; Ernest H. Teske, Green Bay; Peter Hatchell, New Franken, all of Wis.

[73] Assignee: FMC Corporation, Chicago, Ill.

[21] Appl. No.: 566,796

[22] Filed: Dec. 4, 1995

Related U.S. Application Data

[63] Continuation of Ser. No. 409,484, Mar. 21, 1995, which is a continuation of Ser. No. 889,230, May 27, 1992, abandoned, which is a continuation of Ser. No. 651,676, Feb. 6, 1991, Pat. No. 5,161,793.

[51] Int. Cl.[6] ..... B65H 29/68

[52] U.S. Cl. ..... 271/183; 271/216; 414/789.9; 270/42

[58] Field of Search ..... 271/182, 183, 271/202, 203, 207, 213, 216; 242/59; 414/789.9; 270/42, 43

[56] References Cited

U.S. PATENT DOCUMENTS

| | | | |
|---|---|---|---|
| 3,685,823 | 8/1972 | Chambon | 271/182 |
| 4,000,864 | 1/1977 | Kurtz et al. | 242/59 |
| 4,285,513 | 8/1981 | Kwasnitza | 271/183 |
| 4,436,302 | 3/1984 | Frye et al. | 271/183 |
| 4,528,794 | 7/1985 | Thierstein | 53/118 |
| 5,265,863 | 11/1993 | Becker | 271/183 |

FOREIGN PATENT DOCUMENTS

| | | | |
|---|---|---|---|
| 66529 | 12/1982 | European Pat. Off. | 271/183 |
| 2230515 | 10/1990 | United Kingdom | 271/182 |
| 2277924 | 11/1994 | United Kingdom | 271/182 |

*Primary Examiner*—William E. Terrell
*Assistant Examiner*—T. Kelly
*Attorney, Agent, or Firm*—Michael C. Penn

[57] ABSTRACT

Rolls of individual plastic bags are formed on apparatus that overlaps the bags before the bags are fed into the roll to provide a compact roll of individual bags. The apparatus overlaps portions of the bags so that a plurality of bags can be continuously fed into the roll even though the bags are not mechanically connected end-to-end to adjacent bags on the roll.

2 Claims, 7 Drawing Sheets

INTERLEAVING APPARATUS FOR ROLLED UP SEGMENTS

This is a continuation of application Ser. No. 08/409,484 filed Mar. 21, 1995 which is now allowed, which is a continuation of application Ser. No. 07/889,230 which is now abandoned, filed May 27, 1992 which is a continuation of application Ser. No. 07/651,676 filed Feb. 6, 1991, now U.S. Pat. No. 5,161,793.

BACKGROUND OF THE INVENTION

1. Field of the Invention

This invention has to do with apparatus for the production of a plurality of individual bags rolled up to form a package of bags on a roll. The individual bags are wound up with the leading edges of trailing bags overlapping the trailing edges of leading bags as the bags are fed into the windup apparatus forming the roll.

More specifically a windup apparatus is provided wherein a well known turret style winder is used to make rolls of bags, or other elements in a broad sense. A turret style winder is commonly used in winding up a web of bags which are perforated between the bags but connected on the final roll. The bag segments are held together at the perforations in the roll of bags and provide an easily separable juncture between longitudinally adjacent bags. The consumer tears bags off the roll at the perforations as a bag is needed. The only time the perforation is used to separate adjacent bags by the equipment is when a predetermined number of bags-for instance twenty-five bags constituting a roll of bags-has been wound up by the winder. Upon reaching a count of twenty-five bags the well known equipment will sever the perforation between the twenty-fifth and the subsequent bag. A new roll of bags will be started onto a core, or a coreless winding shaft when coreless rolls of bags are wound, which has been sequenced into position on the turret winder.

Most usually, rolls of plastic bags are wound into a coreless roll although sometimes bags on cores are desired. The type of bag most typically found on a coreless roll are bags known as trash or garbage bags. These bags are folded lengthwise to make a narrow compact segment about thirty inches long and six to eight inches wide. When the bags are unfolded they may be within the range of twenty-four to thirty-two inches wide. These dimensions are only one example of possible bag sizes. Obviously garbage bags can be of a whole range of sizes. Consider, for example, bags to wrap deployed Christmas trees, bags to line so-called fifty-five gallon drums, sandwich size bags and other longitudinally and transversely folded and unfolded bags.

Additionally, other items can be wound up on turret rollers of the type discussed herein. For instance elongated or longitudinally folded banners, signs, bumper stickers, precut tape segments, tubes of plastic or other material, woven products such as precut bandages, etc. The list of items that can be rolled up and dispensed from a roll is long. If these items have to be connected together, end-to-end, as it were, there are limits to the list of items that can be wound into a roll. For instance if bumper stickers are held together by a perforation a somewhat undesirable ragged end/edge could result when they are pulled apart by the consumer. So also with precut tape segments and bandages. And, of course, so also with longitudinally folded bags. But if the segments are simply wound up as discrete elements then as they are unwound for use there is no degradation of the segments as they are pulled off the roll.

SUMMARY OF THE INVENTION

One way of winding bags (or elements) into a roll of bags is provided by the invention disclosed herein.

The key element of this invention is the apparatus and method of overlapping or interleaving bag segments so that one bag follows another onto the roll being formed without an interruption between the bag segments. As the windup core spindle is driven, in a preferred embodiment, a gap between bag segments would necessitate the starting and guiding of each bag onto the roll of bags being formed. This is a difficulty. The first bag guided onto the spindle is held on the spindle in the applicant's device, as well as in prior art devices, by vacuum between the spindle and the first layer of bag. There is no vacuum for the second bag hence it is difficult to get the second bag to start onto the top of the first bag.

One solution to this problem is to interleaf the bags so that the leading edge of a second or trailing bag is overlapped over the trailing end of a first or leading bag such that the trailing bag leading end is captured in the bite between the roll of bags that has been formed and the trail end of the leading bag. Once this second bag is started into the roll being formed it is sometimes unimportant that the bags remain overlapped, although an overlap may assist in dispensing bags when they are pulled out of a roll storage container or dispenser.

The bag overlap is established in this invention at an overlap forming zone of the apparatus. The overlapped bags proceed to the windup proper in an overlapped attitude. The overlap forming zone includes the use of air pressure or an air stream directed at the bags in a timed relationship and the use of a bag holding vacuum manifold in one embodiment, The timing of the application of air flow, both pressure and vacuum are important in establishing the desired overlap.

In an alternative embodiment a vacuum box rather than the vacuum manifold is used as will be explained further on.

It should be appreciated that the object of this invention is to provide an overlap in bags being delivered to a windup zone. The method and apparatus presented eliminates the requirement of having bags connected to each other as they are being wound up.

Another object of this invention is to provide a roll of bags that will not have to be torn apart at perforations for a consumer to take one bag from a roll of bags.

This invention also provides for product stream "pull through" by means of belts placed against the upper and lower surfaces of bags making up the product stream so that the positive connection between bags (at the perforation) can be done away with. Having the bags connected together to pull the product stream through the windup is not necessary if the overlap is provided and top and bottom belts are utilized.

BRIEF DESCRIPTION OF THE DRAWING FIGURES

DETAILED DESCRIPTION OF THE INVENTION

Figure 1:
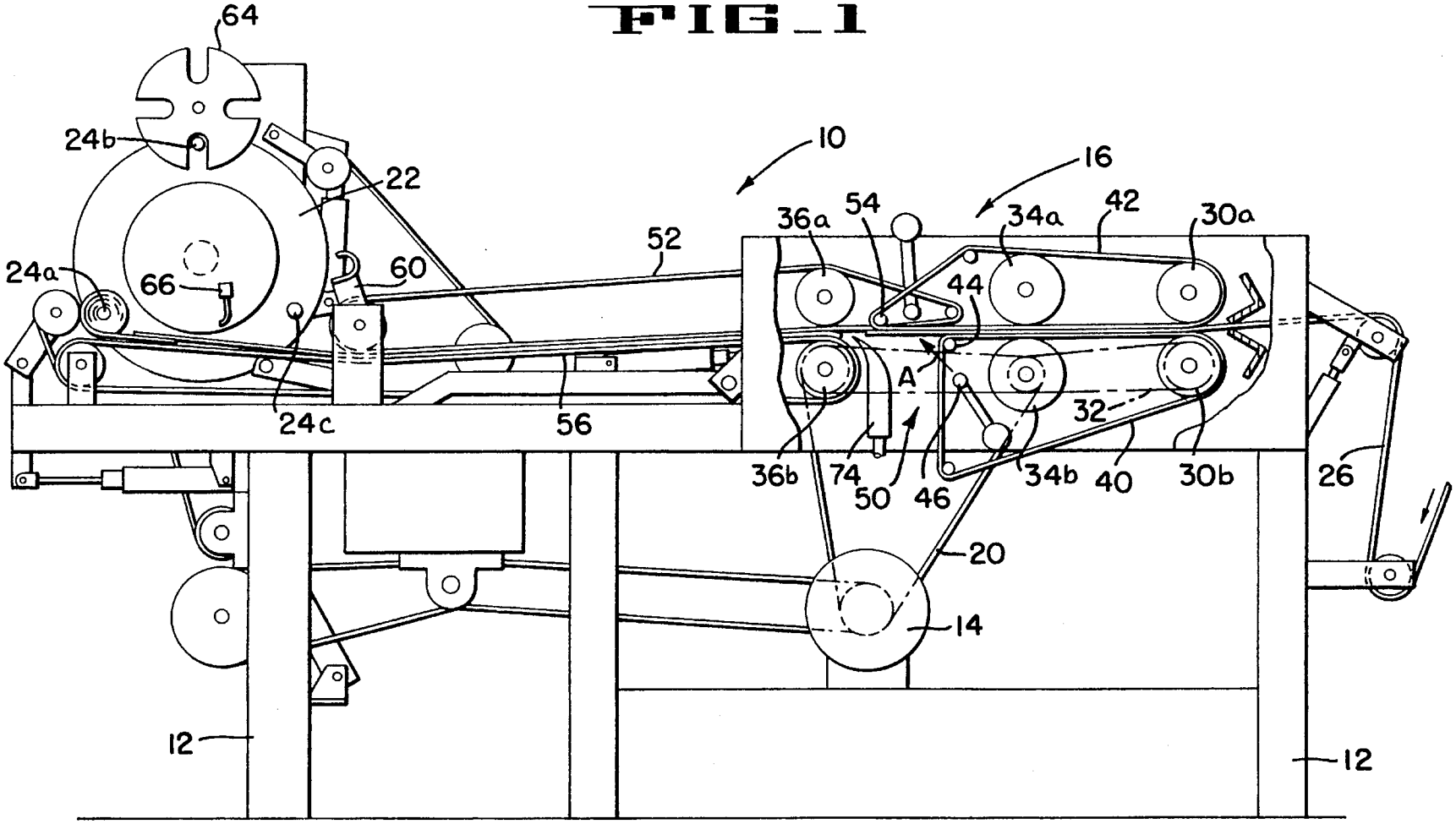
FIG. 1 is a side elevation view of a windup for winding up rolls of product on a turret winder with some parts broken away to show interior components and some nonessential parts left off for clarity.

An appreciation and full understanding of this invention, and various alternative embodiments of it, will be gleaned from a perusal of the drawing figures in juxtaposition to a reading of the following description.

Initially, a preferred embodiment of the invention is shown in FIGS. 1 through 7. Turning first to FIG. 1 the winding apparatus is shown generally as 10.

A frame 12 supports a drive motor 14 which drives an interleaving or overlap forming zone generally 16 through drive belt 20. Downstream of the interleaving zone is a turret winder 22 which supports a plurality of coreless windup spindles, in this case three spindles 24*a*, 24*b* and 24*c*. Various components of the apparatus will be described by following the path that a bag follows. It should be pointed out that the term "web", "segment" or "bag" is being used to describe any product that would be wound up into a roll such as longitudinally folded or longitudinally and horizontally folded trash bags, separated elements or the like any product that described above or any product that would logically be wrapped into a roll.

A continuous web or sheet of film 26 enters the windup at an infeed end thereof. This web would typically have cross seals and perforations at each seal that was formed in the web upstream of the winder. The web could have been folded longitudinally to make several layers of film prior to entering the winder. This would be the usual situation for bags. The web is drawn into the feed rolls 30*a* and 30*b* which are driven by motor 14 through belt 20 and a second driving belt 32. The feed rolls 30*a* and 30*b* are speed matched with the output feed rolls on the bag machine (not shown). Rolls 30*a* and 30*b* may be constantly pushed together by air cylinders (not shown) to maintain pressure on the web 26. The web 26 will proceed downstream generally passing through a gap between a nip roll set or set of separation rolls 34*a* and 34*b*.

The drive belt 20 may be a notched timing belt which also drives a driving roll 36*b* and, as stated above, the nip roll 34*b*. A second pulley (not shown) on the nip roll 34*b* drives the second timing belt 32 to drive the feed roll 30*b*. The pulley on the nip roll 34*b* is smaller than the related pulley on the driven feed roll 30*b* so that the surface speed on nip roll 34*b* is greater than the surface speed on feed roll 30*b*.

The driving roll 36*b* is normally driven at a slower speed than the feed roll 30*b* thus yielding a decrease in web speed between the infeed side of the interleaving zone, generally 16, and at the output side of the zone. Normally, in current state of the art winders known to the inventors there would be no speed differential between the set of feed rolls 30*a* and 30*b* and the set of driving rolls 36*a* and 36*b*. But in this invention these sets of rolls are driven at different speeds. This is the first difference between the prior art winders and the winder presented herein.

The web 26 is carried between a first lower belt 40 and a first upper belt 42 until the first lower belt turns away from the first upper belt at roller 44. If the leading edge of the web went straight to the next set of rollers 36*a* and 36*b*, which it does, it would follow a generally straight plane. The medial section of the web however doesn't follow this plane, but is urged out of it. The web will be forced against the first upper belt 42 after the web passes the area of roller 44 by means of a blast of air emanating from a first directed air flow delivery manifold 46 which will provide a timed blast, positive pressure air flow or curtain of air, as shown by arrow "A", at the bottom of the web 26 in the overlap forming zone, generally 50, to urge the web against the first upper belt 42. Belts 40 and 42 can be nylon elastic belts made up of a plurality of individual rope like round elements. The air curtain, arrow A, will assure that the leading edge of the web 26*a* is directed to and enters the nip between the driving rolls 36*a* and 36*b*.

The actual overlap forming operation will be described below, however for the moment the path of the web, now separated into individual bags or segments, will be followed through the FIG. 1 elevation view of the winder.

The overlapped bags will be transported, on second lower belt 56 and under the second upper belt 52 to a spindle 24. The preferred embodiment utilizes spindles that are provided with apertures in their surface connected to an interior passage through which a vacuum can be drawn. Upon starting to wind up a coreless roll of bags, an empty spindle such as 24*c* will be indexed to a position on top of the web segments being wound up downstream at spindle 24*a*. Timed to coincide with spindle 24*c* being indexed an air horn 60 will be pivoted downwardly generally above the spindle 24*c*. When the leading edge of the first bag to be rolled up on the spindle 24*c* approaches the spindle the vacuum through the apertures in the spindle will cause the leading edge of the first bag to wrap around the spindle 24*c*. The air horn will direct a blast of air at the outside surface of the first bag to help it get started on the rotating spindle 24*c*. The supporting conveyor may also be raised slightly to sere the new bag to the spindle, Once the first bag (and possibly more than one bag) is secure on the spindle the turret 62 will index to the position shown in FIG. 1 and a roll of bags will then be formed on spindle 24*c* as is shown on spindle 24*a*.

As the turret indexes to the next spindle the full roll will be indexed to the uppermost turret position, shown occupied by empty spindle 24*b*, where pusher 64 will push the full roll of bags off the spindle 24*b*. In a preferred embodiment the vacuum on the spindle has been reversed at this point to provide positive air pressure as the roll of bags is being pushed off the spindle.

One other optional item is shown in FIG. 1 and that is the air delivery manifold 66. This unit delivers a stream of air toward the leading edge of the bag as the bag approaches the roll of bags as shown in the Figures. This air stream helps to keep the leading edge of the bags down against the trailing end of the previous bag as the leading end approaches the roll.

Turning now to FIGS. 2–7 the overlap forming and interleaving operation will be described by discussing the progressive figures from FIG. 2 to FIG. 7.

Figure 2:
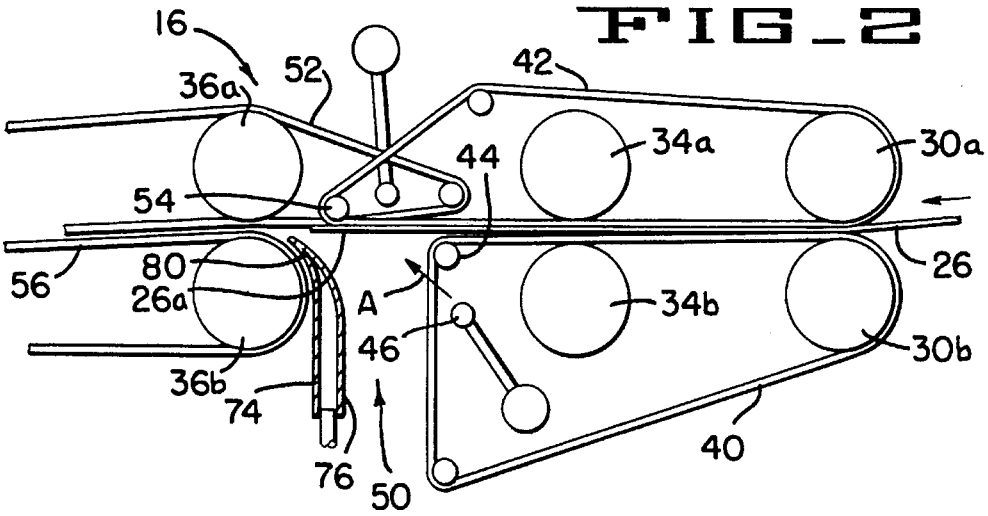
FIGS. 2–7 are pictorial schematics of an overlap forming zone showing the progressive development of a series of bags through the overlap forming zone.

As can be seen in FIG. 2 the leading edge on leading end 26*a* is being held up against the first upper belt 42 by the air blast indicated by arrow A. The bag or web 26 is, of course, being driven downstream by the feed rolls 30*a* and 30*b* between driven belts 40 and 42.

Figure 3:
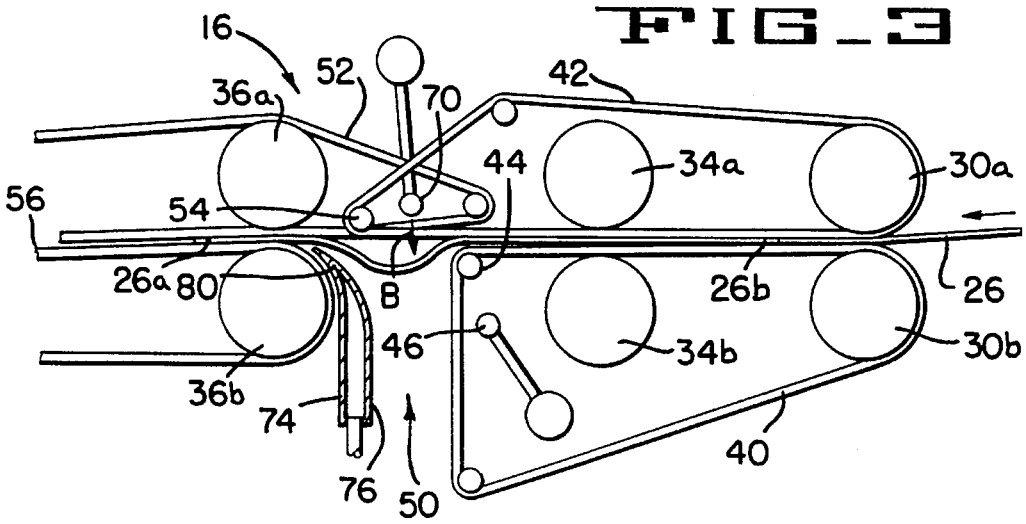

As the leading end 26*a* is nipped at driving rolls 36*a* and 36*b* the air supply at the first directed air flow delivery manifold 46 is shut off. Driving rolls 36*a* and 36*b* are driven at a speed slower than feed rolls 30*a* and 30*b* so a loop will form in the web 26 in the loop forming or overlap forming zone 50 as shown in FIG. 3. To assist in forming the loop a discharge of air emanates from a second directed air flow delivery manifold 70 in the direction indicated by arrow B.

The trailing end of each bag or web segment, shown as 26*b* has been perforated upstream of the winder as stated above. When this perforation just passes the feed roll set 30*a* and 30*b* and reaches a preselected location the nip or separator roll set 34*a* and 34*b* will be urged together to create a nip that drives the web faster than the normal web speed of feed roll set 30*a* and 30*b*. The faster web speed of nip rolls 34*a* and 34*b* relative to feed rolls 30*a* and 30*b*, see FIG. 4, will increase the tension in the web between these two sets of rolls and separate the web into individual web segments or bags at the perforation. A gap such as 72 will form between the web segments. The nip rolls 34*a* and 34*b* then will be opened or separated from each other before the leading end 26*a* of the following web segment reaches to the nip roll set 34*a*, 34*b*. This action thus separates each trailing end of the leading bag or web segment from the leading end of the successive bag segment on the continuous perforated web 26.

Figure 4:
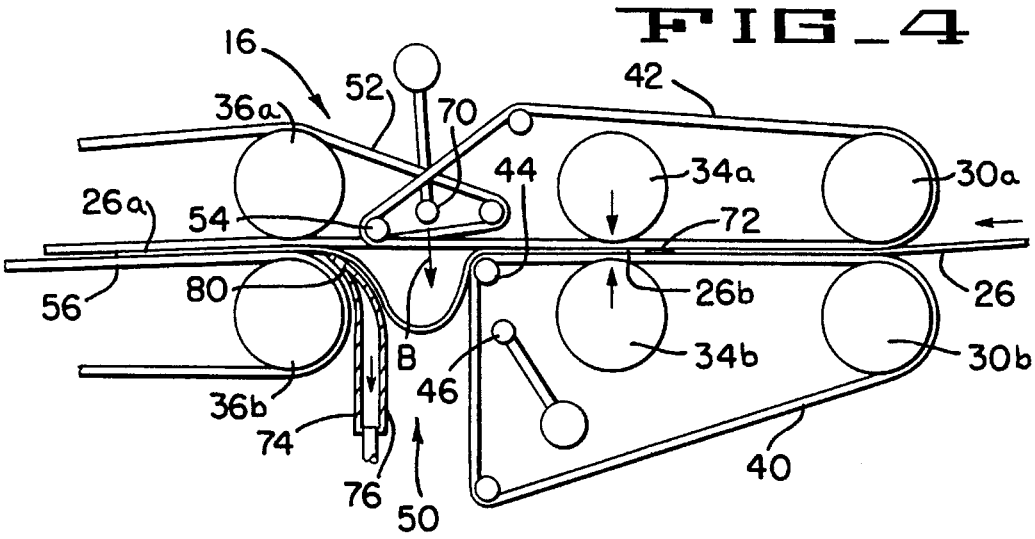
Figure 5:
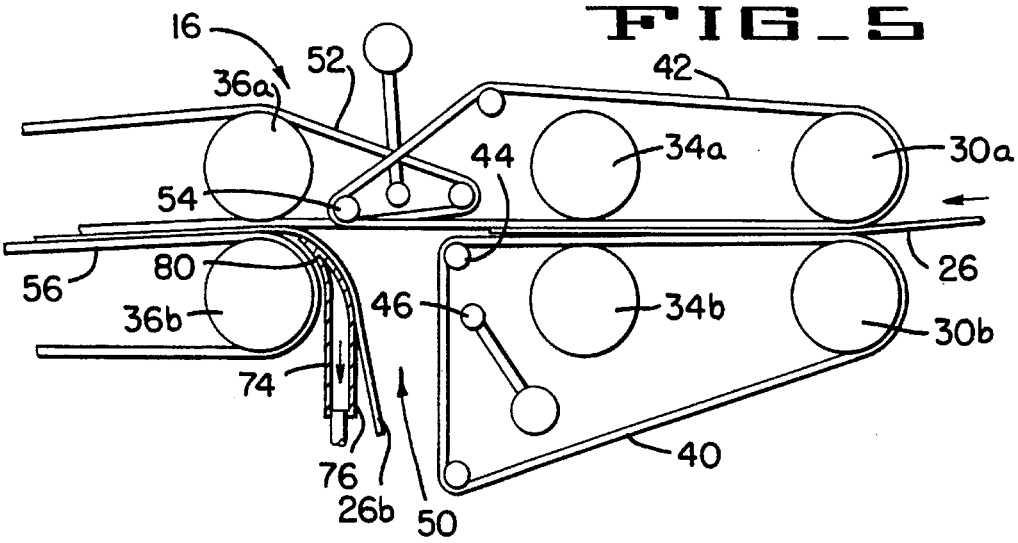

Looking at FIGS. 4 and 5 just after the trailing end 26*b* of the bag leaves the nip rolls 34*a* and 34*b* a blast of high pressure air, identified by arrow B emanates from the second directed air flow delivery manifold 70. This high pressure blast of air will push the trailing end 26*b* of the bag into the overlap forming zone 50 so that it is directed (by gravity assist or otherwise) into contact with the vacuum manifold 74. The vacuum manifold is a structure having a front face 76 provided with a plurality of perforations therethrough, such as 80, that draws air flow into them and urges the bag 26 to be held closely to the front face of the vacuum manifold.

Figure 6:
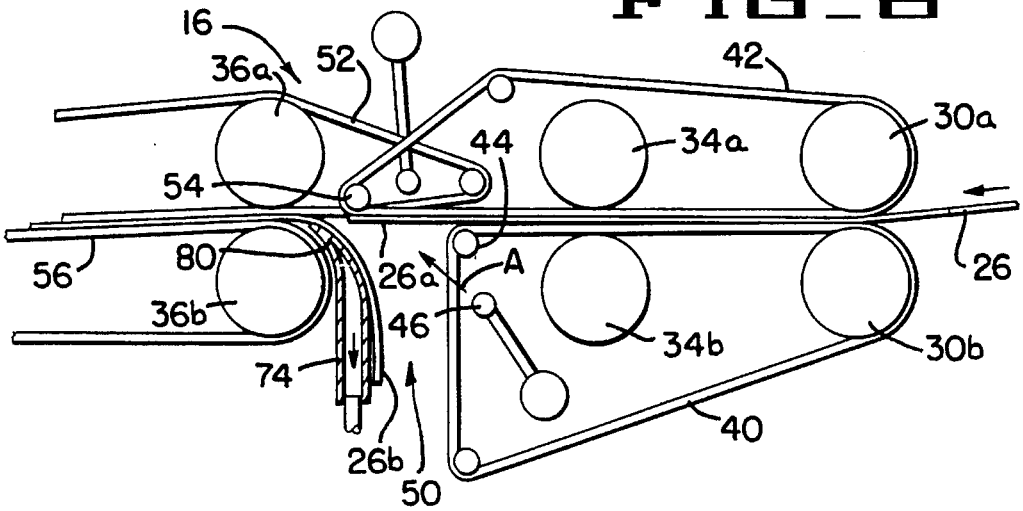
Figure 7:
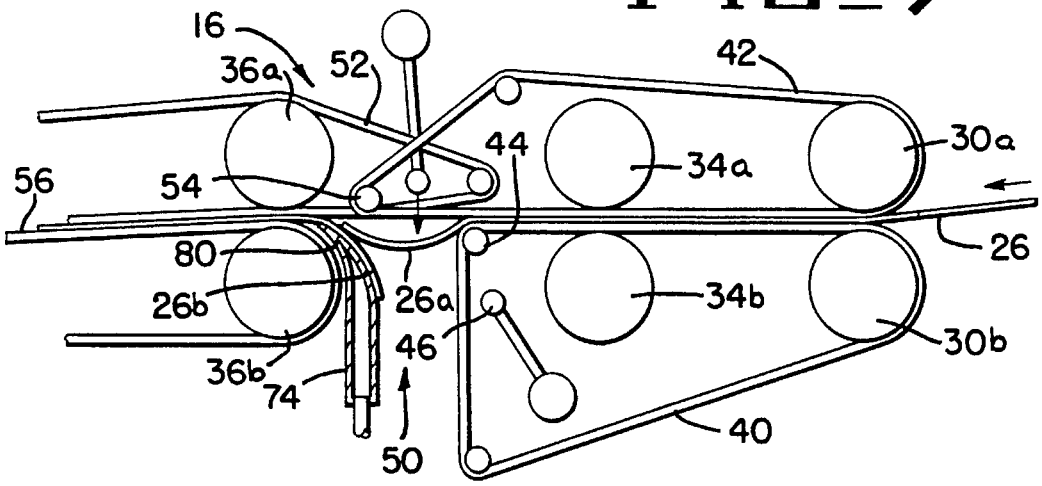

The trailing end portion 26*b* of the bag will continue to travel toward the turret winder 22 at a slower rate than the leading end 26*a* of the next bag as it is being driven through the feed rolls 30*a* and 30*b* (FIG. 6). The leading end 26*a* of the incoming bag will be guided onto the top of the trailing end 26*b* of the previous bag as is shown in FIG. 7 and once its leading end is trapped between the previous bag and the second upper belt 52 it will be drawn through the system as was the first bag described above.

It is expected that for some applications the second bag will easily become mated with the trailing end of the first bag as the bags are overlapped and drawn into the driving rolls 36*a* and 36*b*, however for some web elements or bags it may be desirable to create a light or temporary adhesion between the trailing end of one bag and the leading end of a second bag in the overlap area. The inventors contemplate that this could be done in various ways. For instance, an adhesive material, which could be a "sticky" material or even water for that matter, could be injected into the high pressure air stream "B" when the trailing end of the bag is being blown in FIG. 4. The adhesive could, alternatively be injected into and blown toward the bottom side of the leading end 26*a* of the bag with air flow "A" (FIG. 2).

Alternatively an adhesive material could be applied by an independent applicator to the top of the trailing end or to the bottom of the leading end of the next incoming bag.

Another alternative is to apply a static charge on the top side of the trailing end of the bag segment or under the leading end of the next incoming bag from a static charge inducer.

Once the overlap has been formed, the web, consisting of the overlapped bags or other segments, is supported on the second lower belt 56 to the turret winder 22 where a roll of interleaved or overlapped bags or segments are rolled up.

Figure 11:
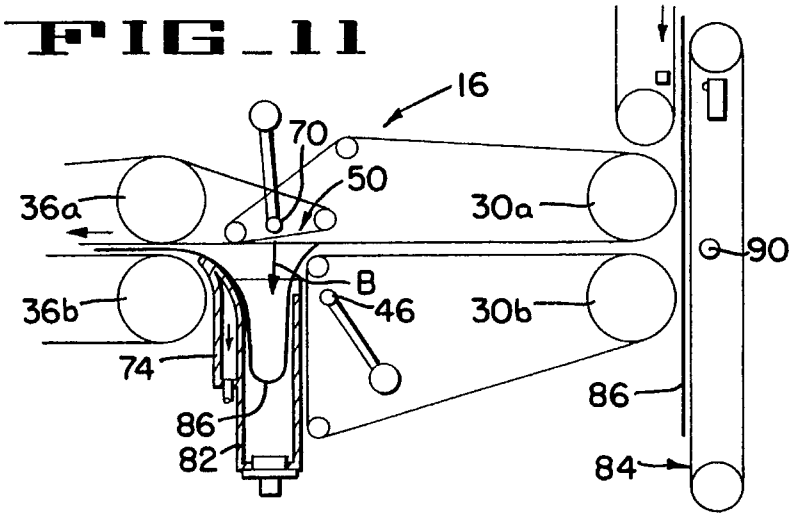

Another alternative embodiment of the invention is shown in FIGS. 8–15. In this embodiment a vacuum box 82 is added as an additional control means to assist in loop formation. The loop forming cycle would be the same as the cycle shown in FIGS. 2–7 however a source of vacuum would be supplied to the vacuum box (from a vacuum pump, not shown) as the loop is being formed in the vacuum box 82 as shown in FIG. 11. The vacuum box, shown in a cross sectioned or cut away view would be closed on all sides except the top where the bag would be drawn into the vacuum box. In a preferred embodiment the vacuum manifold 74 would be integral with the vacuum box and perform the same function it did in the preferred embodiment described above.

Figure 8:
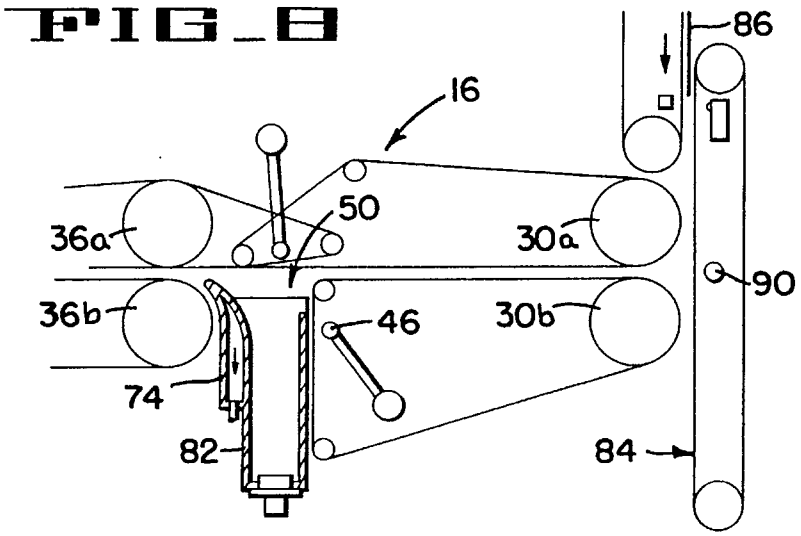

FIGS. 8–15 also show how a folded bag or folded segment could be handled. In FIG. 8 the folder, generally 84, which is well known in principle, is used to fold the individual bags or web segments transversely rather than longitudinally as was done upstream in the earlier preferred embodiment. The transverse fold allows long articles to be folded "in half" to use the term loosely, so that when the bags are unrolled from the final roll the consumer would only have about half as much web length to remove from the roll to get one bag off.

In this alternative embodiment individual bags could be delivered to the winder unit from an intermittent bag making machine or a continuous motion bag maker which seals and perforates the web and separates each bag from the continuous web.

Bags, such as 86 (One single reference number used for each bag. Although they may be different unities they are identical structures), would be folded by a conventional air knife 90 which would direct a timed blast of air, "D" in FIG. 9, to fold the bags into the nip of the winder feed rolls 30*a* and 30*b*. Note that in this embodiment the nip rolls 34*a* and 34*b* of the first embodiment are not needed as the bags arrive at the overlapping zone 50 independent of each other.

The speed of the feed rolls 30*a* and 30*b* would be set at about ten percent faster than the incoming film speed from the bag maker or folder. This would open a gap between the individual bags.

Due to the double thickness of the now folded bag additional loop forming control, provided by the vacuum box 82, could be advantageous. Vacuum supply to the box 82 could be an air amplifier, a vacuum pump, a fan or the like.

Figure 9:
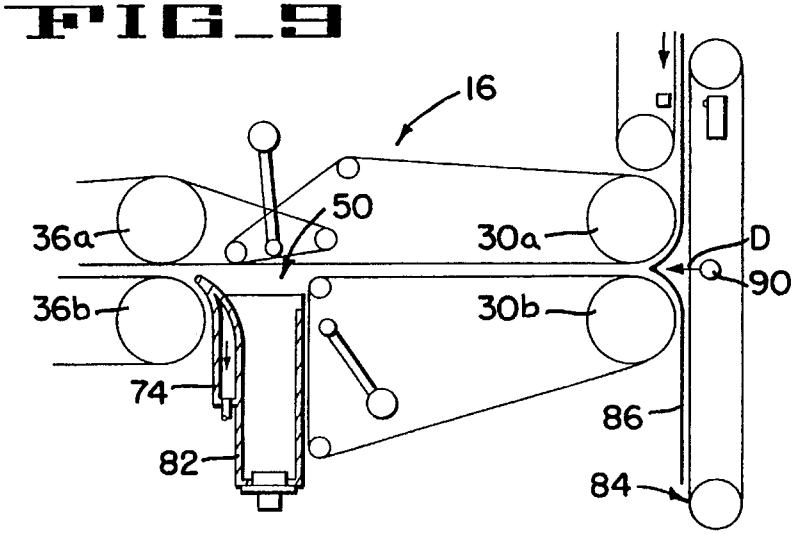
FIGS. 8–15 are pictorial schematics of an alternative overlap forming zone showing the progressive development of a series of bags through the alternative overlap forming zone.
Figure 10:
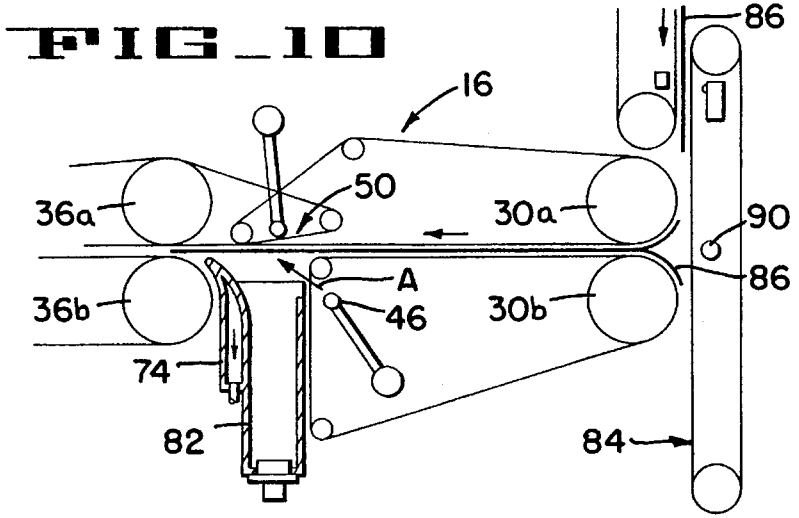
Figure 13:
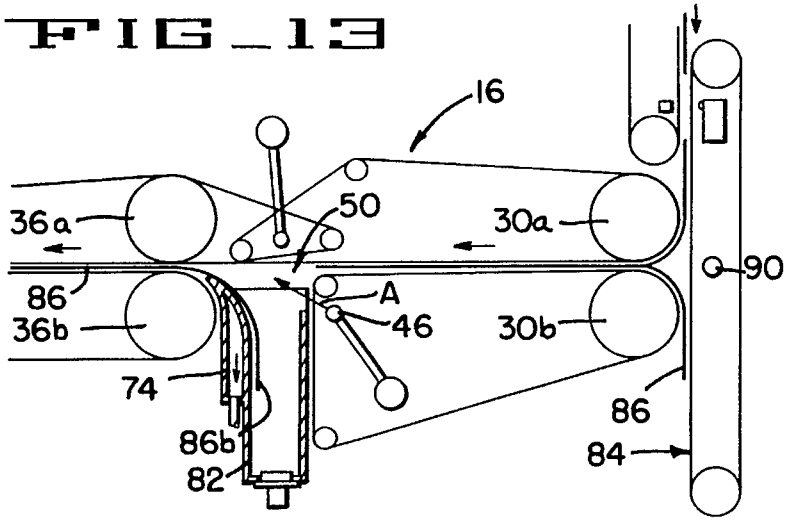

In FIGS. 8, 9 and 10 a bag 86 has been folded and is carried to the interleaving or overlapping zone 50 by the first upper and lower conveyor set.

Figure 12:
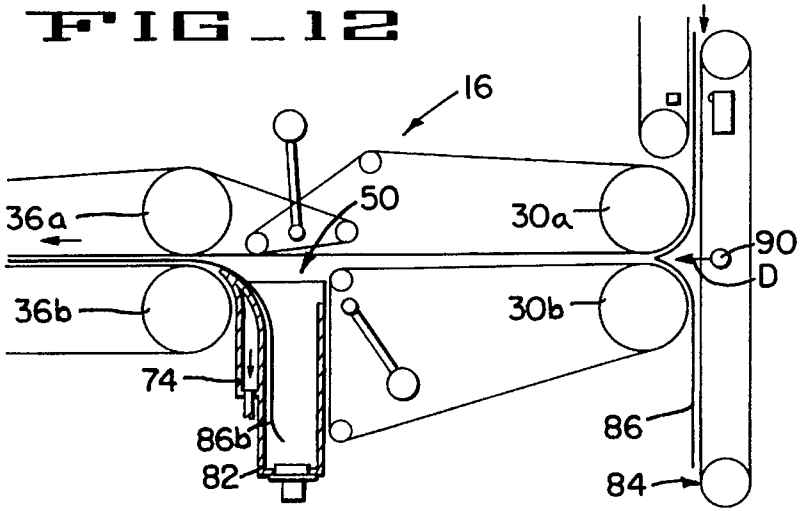
Figure 14:
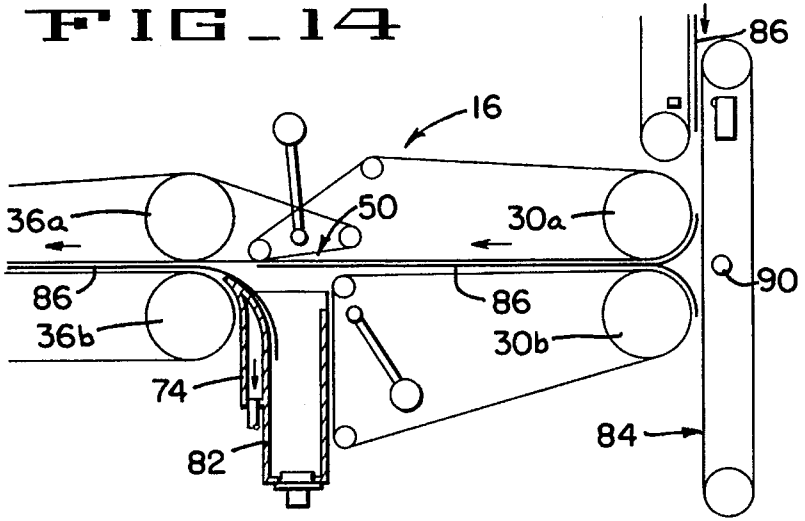

The air flow "A" from the first directed air flow delivery manifold 46 assists the leading end of the bag to reach the nip of the driving rolls 36*a* and 36*b*. Once the bag has bridged the gap over the vacuum box 82 air flow "B" is directed from the second directed air flow delivery manifold 70 to assist in loop forming. See FIG. 11. Additionally vacuum is supplied to the vacuum box 82 to suck the bag into the box to form the loop. The bag continues to travel to the turret winder as shown in FIG. 12 and the trailing end 86*b* of the folded bag 86 is drawn toward the vacuum manifold 74 and held against the vacuum manifold lightly as the bag continues to be drawn toward the turret winder.

Figure 15:
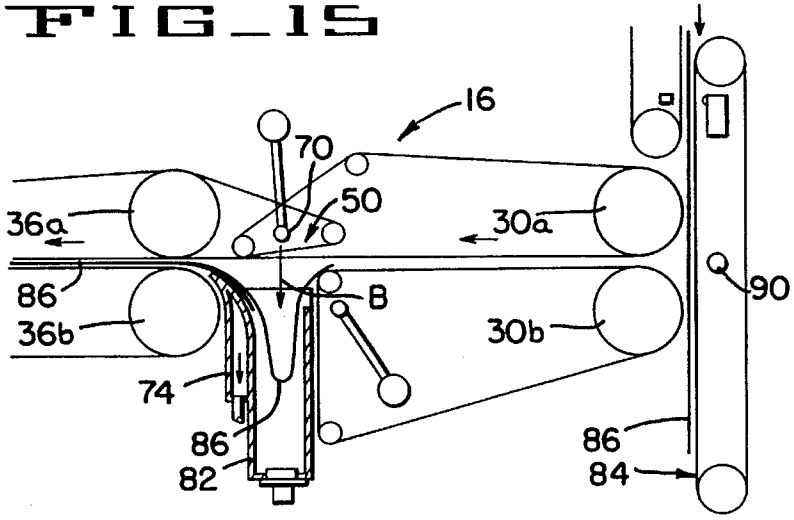

As shown in FIG. 15 a second bag has been fed into the nip of the driving rolls 36*a* and 36*b* and has been blown and sucked into the vacuum box 82 by the second directed air flow delivery manifold 70 and the vacuum box itself respectively. In this FIG. 15 the leading end of the second bag has been placed over the trailing end of the previous bag and the principle used is the same as that described in the preferred embodiment.

Adhesive enhancement, as described above, could also be used in embodiments where folded bags are being interleaved or overlapped.

One enhancement is that where folded bags are being rolled up the fold could be placed such that the fold doesn't occur in the middle of the bag but is offset thereby leaving a single bag (although the bag would have several layers due to a longitudinal fold) thickness at the trailing ends of the folded bag. This could reduce the possible problem of winding different thicknesses of web or film on the final roll.

Another embodiment of the invention utilizes a mechanical loop forming control instead of the air flow dependent loop forming embodiments set forth in FIGS. 1–15. In FIGS. 16–23 a mechanical loop forming device is set forth. It is shown handling transversely folded bags coming from a folder generally 84 as was shown in the immediately previously described alternative embodiment.

In this mechanical loop forming embodiment a cam 92 operates in cooperation with a rocker arm 94 in a well known manner to urge a deflectable belt 96 which is the top belt of a two belt set between which the bag 86 is carried. (Although a cam actuated device is shown numerous alternatives such as air cylinders, hydraulic cylinders, chains, gears, etc. could be used to cycle the deflectable belt from one location to another.)

Figure 16:
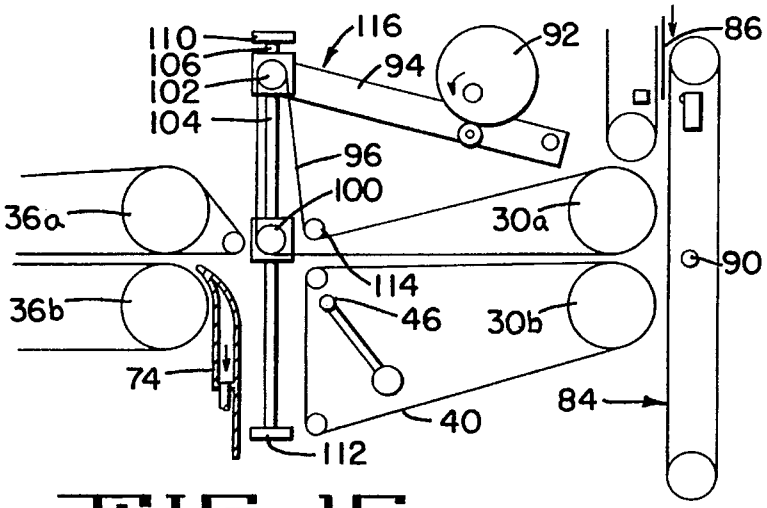
Figure 18:
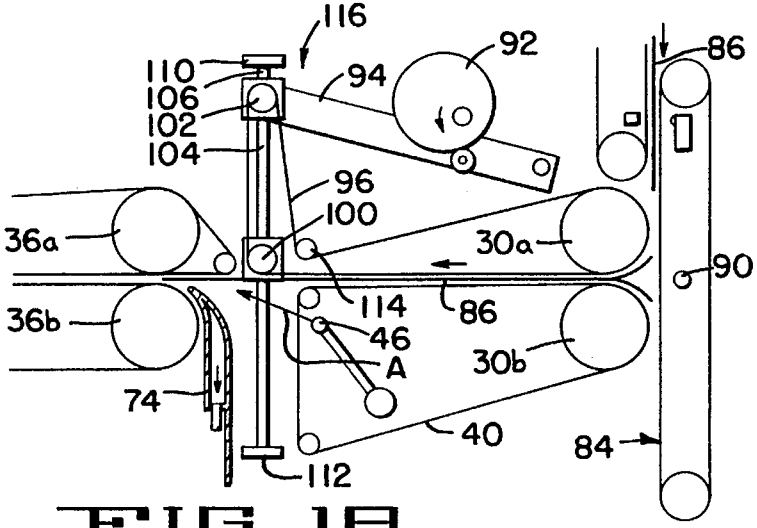
Figure 21:
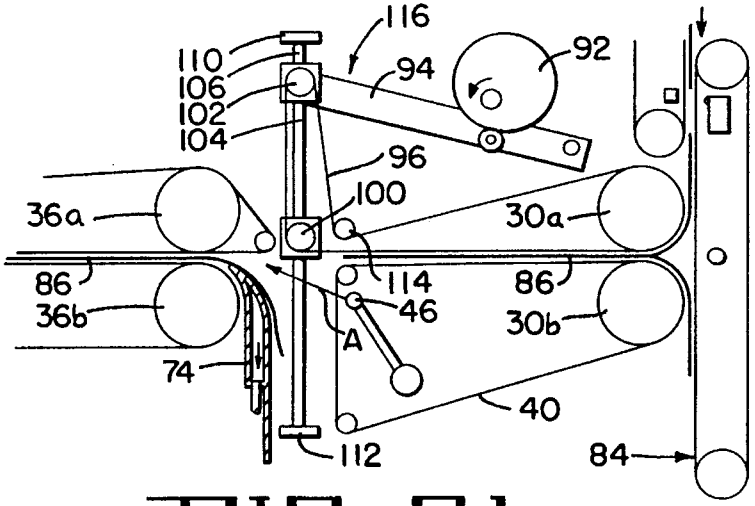

The deflectable belt 96 is entrained around a pulley associated with the feed roll 30*a* which serves to drive the belt. This could be a "rope" style belt as described earlier. The deflectable belt travels to a first idler roller 100 and thence to a second idler roller 102 which are mounted together on a spacer 104 which serves to maintain a given distance between rollers 100 and 101. The spacer 104 and the associated rollers 100 and 101 are mounted to guide means such as 106 extending from a mount 110 to a second mount 112 as shown in FIG. 16.

The deflectable belt 96 is also entrained around fixed idler 114. The deflectable belt maintains a given length and is not appreciably stretched as it moves with the spacer 104.

Figure 17:
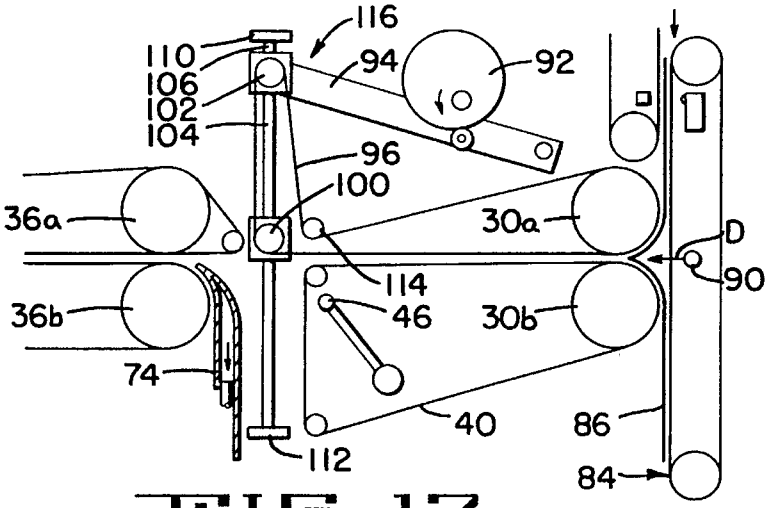
FIGS. 16–23 are pictorial schematics of an alternative embodiment showing the progressive development of a series of bags through the alternative overlap forming zone.

In FIG. 17 a bag 86 is just starting into the feed roll nip. The folded leading end of the bag will bridge the gap over the interleaving zone with the help of the curtain of air flow A emanating from the first directed air flow delivery manifold 46. To this point the process is as described above concerning the second major embodiment.

Figure 19:
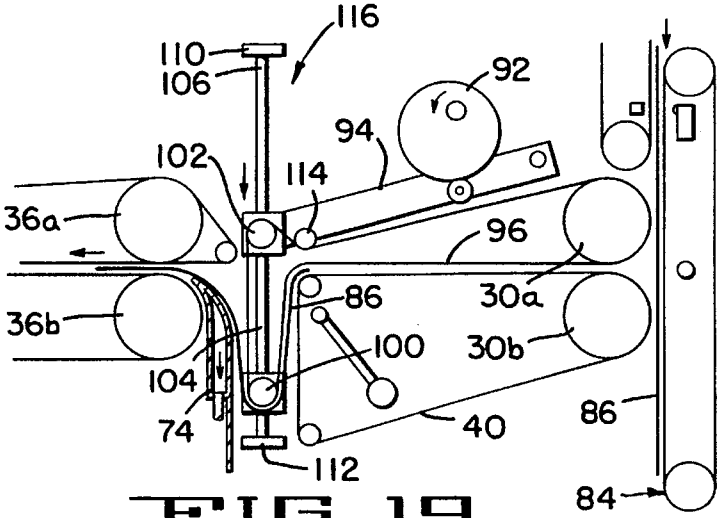
Figure 20:
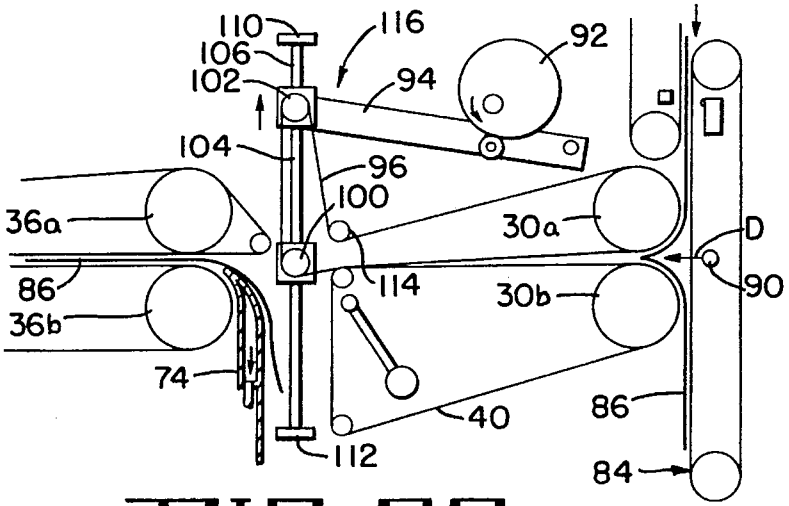
Figure 23:
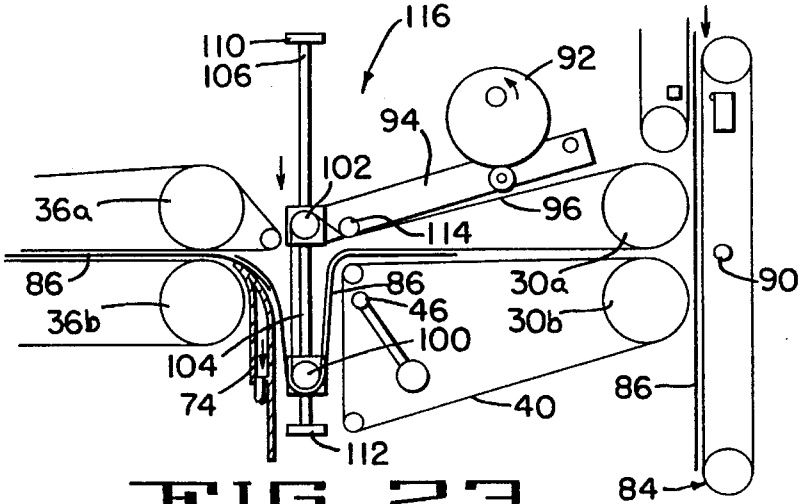

In this embodiment an air blast is not used to form the loop in the bag, neither is a vacuum box. Rather the mechanical loop former generally 116 is used to form the loop. With the bag 86 shown in position in FIG. 18, the spacer 104 will be urged to move by the rotating cam 92 action on the rocker 94 as shown in FIG. 19 or other equivalent means. The bag will be forced into the area between the vacuum manifold 74 and the first lower belt 40 as the deflectable belt 96, which is pressed against the top side the bag, follows the first and second idler rollers 100 and 102 into the loop forming and overlap forming zone. Once the deflectable belt 96 has positioned the bag the cam 92 will continue to rotate and the rocker arm, which may spring loaded against the cam, will carry the spacer, which is attached to the rocker arm 94 out of the overlap forming zone. At this point the vacuum will be on in the vacuum manifold 74 and the trailing end of the bag 86, as shown in FIG. 20 will be urged toward the face of the vacuum manifold. It should be mentioned that in FIGS. 20–22 the trailing end of the bag 86 does not appear to be flush against the face of the vacuum manifold however in operation the bag would normally be right against the face. It shows up a bit more clearly in the figures with the bag slightly off the face—which however does happen with some materials.

Figure 22:
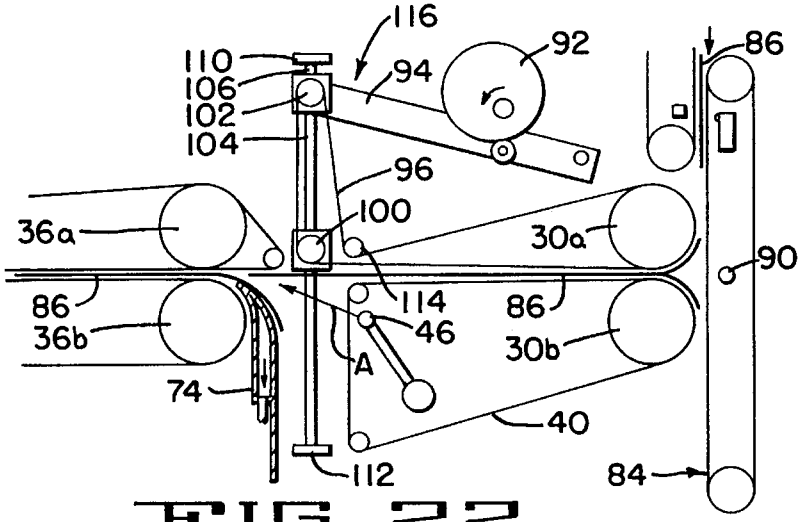

FIG. 22 starts the cycle over with the second bag having bridged the gap. The cycle continues as previously described and bag after bag follows the previous bag and is interleaved or overlapped therewith as can be seen in the figures and as explained.

In a broad recitation it can be seen that what has been described is a method of interleaving web means by individualizing a first web segment from a trailing web segment and then guiding the leading edge of the first web segment into a downstream gripping means. Once this is done the apparatus will urge a medial section of the first web segment out of the plane followed by the leading edge of the first web segment. The trailing edge of the first web will also be urged out of this plane and both the medial section and the trailing section will enter a zone upstream of said downstream gripping means. The leading edge of a second or trailing web segment means will then be guided into the gripping means before the trailing end of the first web means passes completely through the gripping means.

Three embodiments of this invention have been shown. Each shares the concept of interleaving or overlapping cut segments of web so that they can be wound up as if they were a continuous web when they reach the turret winder. Several further embodiments are contemplated by the inventor—such as having the overlap zone rotated from a vertical deployment—it could just as easily be horizontal—or using adhesive in each of the embodiments. The following claims attempt to cover the invention herein however every nuance of design not claimed but within the spirit of these claims is believed to be within their scope.

We claim:

1. A method for overlapping individual plastic webs of material comprising the steps of:

feeding a continuous sheet of plastic film having perforations thereon in between a pair of feed rolls driven at a first speed, said perforations defining individual plastic webs to be formed;

separating a leading individual plastic web and a trailing individual plastic web at a perforation between said webs;

interleaving said individual leading and trailing plastic webs;

providing said interleaved webs to a pair of driving rolls driven at a speed slower than said first speed, and providing said interleaved webs to a winder, said winder being downstream from said driving rolls.

2. The method of claim 1 wherein said plastic webs are segments of bags.

* * * * *